United States Patent [19]

Bain et al.

[11] 4,263,071

[45] Apr. 21, 1981

[54] ADDITIVE FOR REDUCING COMBUSTION INSTABILITY IN COMPOSITE SOLID PROPELLANTS

[75] Inventors: Leland S. Bain, San Jose; Thomas P. Rudy, Saratoga, both of Calif.

[73] Assignee: United Technologies Corporation, Hartford, Conn.

[21] Appl. No.: 490,159

[22] Filed: Jul. 19, 1974

[51] Int. Cl.[3] ..... C06B 45/10; C06D 5/00

[52] U.S. Cl. ..... 149/19.9; 60/219; 149/19.4; 149/19.5; 149/19.6; 149/19.91

[58] Field of Search ..... 149/19.9, 19.5, 19.4, 149/19.91, 19.6

[56] References Cited

U.S. PATENT DOCUMENTS

| | | | |
|---|---|---|---|
| 3,248,410 | 4/1966 | Berenbaum | 149/19.91 X |
| 3,677,839 | 7/1972 | Sayles | 149/19.9 |
| 3,839,105 | 10/1974 | Dewitt et al. | 149/19.91 X |

*Primary Examiner*—Edward A. Miller

*Attorney, Agent, or Firm*—Steven F. Stone

[57] ABSTRACT

The addition of copper phthalocyanine to composite solid propellant compositions has been found to substantially reduce the tendency toward combustion instability of the propellant. The invention is particularly useful in connection with smokeless composite propellants employing hydroxy-terminated polybutadiene as a binder.

6 Claims, No Drawings

ADDITIVE FOR REDUCING COMBUSTION INSTABILITY IN COMPOSITE SOLID PROPELLANTS

BACKGROUND OF THE INVENTION

Combustion instability in a composite solid propellant rocket motor is a phenomenon which can be considered to be occurring when the actual chamber pressure observed in the rocket motor exceeds, while operating in the manner intended, the chamber pressure for which the motor was designed, based on propellant burn-rate data obtained from small motor or strand-burning tests. Combustion instability can be characterized either by (a) acoustic oscillations in the chamber pressure which may continue for a portion or all of the burn time of the motor and ususally at a mean pressure higher than that predicted for normal operations or (b) a sudden rapid rise in the chamber pressure which can cause catastrophic failure of the motor. In those cases in which a catastrophic failure of the rocket motor does not occur as a result of the instability, it is still an undesirable phenomenon since most solid propellants are targeted, or their operation predicted, on a knowledge of the pressure-time trace of the rocket motor which directly affects the thrust produced. If the actual chamber pressure is higher than that for which the motor is designed, the motor cannot be used to provide the desired performance with acceptable reliability since predictable ballistic performance depends on a predictable thrust vs. time curve which, in turn, depends on a predictable pressure vs. time program.

Various factors affect combustion instability, and, in general, combustion instability is more likely to occur when rocket motors (a) are operated at higher chamber pressures (b) have greater lengths or length to diameter ratios (c) employ propellants having high solid loadings of oxidizers or (d) are operated at elevated grain temperatures. Various approaches have been taken in the past to solve the problems of combustion instability. These approaches have included the use of resonance rods, the use of exotic grain designs, the use of mass addition techniques to upset the circulation pattern within the combustion chamber, the use of additives such as those disclosed in U.S. Pat. No. 3,336,751, Rifkin et al, Solid Propellant Composition Containing Liquid Organometallic Compound and Method of Use, the use of noncombustible particulate additives, and the addition of a material such as aluminum which produces a fine particulate oxide in the combustion chamber, thereby in some way decreasing the tendency toward combustion stability. The latter technique has been so widely used that state-of-the-art propellants now normally include aluminum as a fuel material, workers in the art sometimes forgetting that the original function of the aluminum was as a stability enhancer.

Unfortunately in many applications, the smoke produced by an aluminum containing propellant cannot be tolerated. For example, in manned spacecraft in which the viewports or cameras are in a position to be exposed to the exhaust fumes, the fogging created upon the firing of such motors can cause complete obscuration of vision. In spin stabilized rocket motors the centrifugal action of the motor causes erratic burning as a result of the centrifuging of the aluminum oxide particles to the wall of the combustion chamber. In tactical weapons systems, the smoke produced by the firing of the motor enables effective countermeasures to be taken against both the missile and the launch site. Recent developments in polymer chemistry have produced hydroxy-terminated polybutadiene (HTPB) binders with which extremely high solids loading of ammonium perchlorate (AP) can be obtained. By obtaining 88 to 90% solid loadings of AP, high specific impulses can be obtained which are very useful in those applications in which smokeless propellants are required. Unfortunately, the high solids loading of AP with HTPB binder result in a propellant which is very susceptible to combustion instability and tends to aggravate the problem already existing as a result of the deletion of the aluminum fuel material. Accordingly, combustion instability is a major problem in advanced smokeless propellants. As has been pointed out above, combustion instability can be caused to occur in the more conventional state-of-the-art propellants merely by choosing to operate them at higher chamber pressures. Thus, while this invention is particularly useful in smokeless propellants, its utility should not be construed as being limited thereto. According to this invention, an additive in relatively small amounts has been found to extend the range of stable burning of composite propellant into regions which, for a particular composition, could not heretofore be obtained.

DESCRIPTION OF THE INVENTION

According to this invention, it has been found that the addition of copper phthalocyanine to composite solid propellant compositions substantially extends the range of conditions under which stable burning can be obtained. This material is useful both in aluminized and nonaluminized propellant compositions employing various rubber binders including, without limitation, PBAA, PBAN, carboxy and hydroxy-terminated polybutadienes, polyisobutylenes, polyethers and polyesters. For purposes of illustration, however, this invention will be described particularly with respect to hydroxy-terminated polybutadiene binders since, at present, these binders are preferred for use in advanced missile systems due to superior ballistic performance resulting from the high degree of solids loading attainable therein.

EXAMPLE 1

A control propellant formulation comprising 12% by weight binder and 88% ammonium perchlorate was utilized for the test procedures. The binder consisted of Arco R-45M (HTPB) cured with dimeryldiisocyannate, plasticized with isodecyl pelargonate (IDP) and containing approximately 0.1% (by weight of the propellant composition) of PRO-TECH®3020 stabilizer (available from United Technology Center, Division of United Aircraft Corporation) as a pot-life extender and antioxidant. A series of rocket motor firings employing 1.5 inch diameter, 5 inch length, internal burning rocket motors was conducted to determine the upper limit of chamber pressure at which stable combustion could be maintained. Once this level was established for the control formulation, a series of test was performed using various additives to determine a corresponding upper chamber pressure limit for stable combustion using each of these additives. In those cases in which the additive was a liquid, it was included in the propellant by substitution for an equivalent amount of the binder. When the additive was a solid, it was included in the propellant composition by substitution for an equivalent amount of the ammonium perchlorate. The results of these tests are set forth below:

TABLE 1

| ADDITIVE | MAXIMUM CHAMBER PRESSURE FOR STABLE BURNING (PSI) |
|---|---|
| Control | 1100 |
| 6% Liquid Polyisobutylene | 1,500 |
| 0.2% Nickel Phthalocyanine | 1,350 |
| 0.2% Nickel Dibutyldithiocarbamate | 1,700 |
| 0.2% Methylcyclopentadienylmanganese-tricarbonyl | 1,500 |
| 1% Carbon Black | 1,700 |
| 1% Spherical Carbon Particles | 1,500 |
| 0.2% Copper Phthalocyanine (CP) | 2,800* |
| 0.2% CP + 0.5% Carbon Black | 2,800* |
| 3.6% Polyisobutylene** + 0.2% CP + 0.5% Carbon Black | 2,800* |

*2800 psi is the upper pressure limit imposed by structural properties of the test motor.
**No IDP plasticizer employed in this formulation.

As can be seen from the above example, the use of the copper phthalocyanine permitted the attainment of chamber pressures far in excess of those obtainable by the prior art solid additives and organometallic compounds and in excess of that obtained by the use of the polyisobutylene which is the subject of co-pending, co-assigned patent application, Ser. No. 490,160 by L. S. Bain for Additve for Reducing Combustion Instability in Solid Propellant, filed on July 19, 1974, and now abandoned. As can be seen, the copper phthalocyanine of this invention can be used both alone or in conjunction with a stabilizing plasticizer such as polyisobutylene and the particulate stablizers such as carbon. While the above Table indicates 2,800 psi as the upper chamber pressure limit for stable combustion this merely reflects the maximum pressure at which the tests could be run due to material limitations in the structure of the test motors themselves. Thus, the 2,800 psi chamber pressure does not indicate that combustion became unstable at 2,800 psi, but merely that tests could not be performed at higher chamber pressures and the upper chamber pressure limits for stable combustion using the organo-copper compound of this invention in the tested motor at this time is not known.

EXAMPLE 2

Similar tests in a 2.75" diameter, 25 inch long motor with a 1 inch center perforated grain resulted in unstable combustion with the HTPB/AP composition of Example 1 at 1000 psi but with the addition 0.5% of copper phthalocyanine, stable combustion was measured up to the test motor limit of 1800 psi. Propellants containing aluminum instead of copper phthalocyanine were also tested and at 2% concentration stable combustion occurs at pressures up to at least 1300 psi but at 0.25% the test resulted in unstable burning starting at 1000 psi. At 1% aluminium oxide and zirconium carbide were ineffective in suppressing combustion instability.

The minimum amount of additve that can be effective has not been determined; however, in view of the dramatic results obtained at the 0.2% level, it is expected that even smaller amounts of the additive will produce some increase in combustion stability for a particular propellant composition. Accordingly, the use of both higher and lower amounts of the additive is contemplated by the applicants with merely routine tests being required to characterize the effect of the additive in any specific propellant composition.

While this invention has been described with respect to a preferred embodiment thereof, it should not be construed as being limited thereto and various modifications can be made by workers skilled in the art without departing from the invention which is limited only by the following claims:

We claim:

1. In a composite propellant composition adapted for combustion at elevated pressures which comprises an organic binder having dispersed therethrough a particulate oxidizing agent, said composition being substantially free from ingredients whose combustion products are solids and being chemically balanced such that the exhaust gas stream is substantially free of particulate materials; the imprpovement whereby stable burning at higher combustion chamber pressure is permitted which comprises a combustion stabilizing amount of copper phthalocyanine dispersed through said propellant composition.

2. The composition of claim 1 wherein said organic binder is the crosslinked product of a polymer selected from the group consisting of PBAA, PBAN, carboxy and hydroxy-terminated polybutadienes and polyisobutylenes, polyethers and polyesters.

3. The composition of claim 2 wherein said polymer is a hydroxy-terminated polybutadiene.

4. A method for increasing the combustion chamber pressure at which a composite solid propellant composition can be burned under stable conditions, said propellant composition comprising an organic binder having a particulate oxidizer dispersed therethrough; said composition being substantially free of ingredients whose combustion products are solid and which composition is chemically balanced such that the exhaust gas stream is substantially free of particulate materials, which method compirses:

(a) dispersing uniformly through said propellant composition a combustion stabilizing amount of copper phthalocyanine and, (b) burning said propellant composition in a stable manner at a combustion chamber pressure higher than the upper limit of stable burning attainable by a propellant composition identical to said propellant composition but being free of copper phthalocyanine.

5. The method of claim 4, wherein said organic binder is the crosslinked product of a polymer selected from the group consisting of PBAA, PBAN, carboxy and hydroxy-terminated polybutadienes and polyisobutylenes, polyethers and polyesters.

6. The method of claim 5 wherein said polymer is hydroxy-terminated polybutadiene.

* * * * *